US007953358B2

(12) United States Patent
Klymachyov et al.

(10) Patent No.: US 7,953,358 B2
(45) **Date of Patent: *May 31, 2011**

(54) CHEMICALLY-TREATED CLEANING WEB

(75) Inventors: Alexander N. Klymachyov, Webster, NY (US); Samuel Kaplan, Walworth, NY (US); John D. Derimiggio, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/512,279

(22) Filed: Jul. 30, 2009

(65) Prior Publication Data

US 2009/0304420 A1 Dec. 10, 2009

Related U.S. Application Data

(62) Division of application No. 11/453,949, filed on Jun. 15, 2006, now Pat. No. 7,580,665.

(51) Int. Cl.
*G03G 15/20* (2006.01)

(52) U.S. Cl. ..... 399/327; 399/328; 399/330; 399/333

(58) Field of Classification Search ..... 399/327–328, 399/330, 333

See application file for complete search history.

(56) References Cited

U.S. PATENT DOCUMENTS 5,736,286 A * 4/1998 Kaneko et al. ..... 430/124.15
5,991,564 A * 11/1999 Ni ..... 399/69
6,799,000 B2 * 9/2004 Aslam et al. ..... 399/69

FOREIGN PATENT DOCUMENTS

JP 62260176 A 11/1987

OTHER PUBLICATIONS

U.S. Appl. No. 11/453,949 (Parent Application), U.S. Appl. No. 11/184,692 (Facci et al), filed Jul. 19, 2005, U.S. Appl. No. 11/275,666 (Gibson, et al), filed Jan. 23, 2006.

* cited by examiner

*Primary Examiner* — Ryan D Walsh
(74) *Attorney, Agent, or Firm* — Richard A. Castellano; Prass LLP

(57) ABSTRACT

A fuser debris inhibiting system and apparatus using an impregnated cleaning web. This web is impregnated with materials of: succinic acid, DPTA, HEDTA, NTA, DMSA or their salts. The web can contact the fuser member directly or can contact external heat rolls which in turn contact the fuser roll.

The delivery of these materials to the surface of the fuser member substantially inhibits the formation of contaminants thereon.

6 Claims, 3 Drawing Sheets

CHEMICALLY-TREATED CLEANING WEB

CROSS REFERENCES TO RELATED APPLICATIONS

This application is a Divisional Application of parent U.S. application Ser. No. 11/453,949 filed Jun. 15, 2006. Ser. No. 11/453,949 has been allowed.

In application Ser. No. 11/184,692, "Release Fluid Additives" (Facci, et al) filed in the U.S. Patent and Trademark Office Jul. 19, 2005, a related invention to the present invention was disclosed and claimed. Both the present and the Facci et al cases are owned by the same Assignee. In Facci et al, an addition of metal chelating agents to fuser release fluids is disclosed wherein said chelating agent substantially prevents precipitation of toner process by-products by binding to metal ions present in a toner. These agents serve to improve the fuser member life, especially in fusing systems that involve toners with zinc stearate additives.

The metal chelating agent in Facci et al is selected from the group consisting of meso-tetraphylporphyrin (TPP), ethylenediaminetetraacetic acid (EDTA), metal-free phthalocyanine variants, diethylenetriaminepentacetic acid (DTPA), N-(hydroxyethyl) ethylenediaminetetraacetic acid (HEDTA), nitrilotriacetic acid (NTA), sodium diethanolglycine (EIMA), 2,3-dimercaptosuccinic acid (DMSA), dimercaprol (oil soluble), amino-ethylethanolamine (AEEA), ethylenediamine (ETA), diethylenetriamine (DETA), and triethylenetetramine (TETA).

The disclosure of Facci et al, Ser. No. 11/184,692 is totally incorporated herein by reference.

While the Facci et al disclosure is concerned with release fluid composition, the present embodiments relate to a particular system to deliver chelating agents into the release fluid and on the roll surfaces. Indeed, most of the chelating agents disclosed in Facci et al are not soluble in silicone oil at ambient temperatures and, as such, cannot be supplied as a preexisting additive. The few soluble chelating agents have drawbacks related to their high price, coloration and/or toxicological concerns. The present invention relates to a system and apparatus that uses an internal cleaning web to deliver otherwise insoluble in release fluid scavenging agents such as EDTA onto the surface of a heating roll and/or fuser roll.

Yet another application Ser. No. 11/275,666 "Method and Materials for Extending Fuser Member Life" (Gibson, et al) filed in the U.S. Patent and Trademark office Jan. 23, 2006, a related invention to the present invention and owned by the same Assignee was disclosed and claimed. Both the present and the Gibson et al cases are owned by the same Assignee. In Gibson et al, a method is disclosed whereby a fuser roll is cleaned by passing the fuser member through an aqueous bath containing EDTA. The EDTA is in a cleaning station and may be used to clean the fuser roll while the fuser roll is still mounted within the marking device it is used in. Alternatively, it may be done by removing the fuser member from the marking device for external cleaning. The EDTA is most suitably applied to the surface of the fuser member when the fuser member is substantially cool, for example, when the fuser member is about 50° C. or less.

The disclosure of Gibson et al, Ser. No. 11/275,666 is totally incorporated herein by reference.

While Gibson et al is concerned with cleaning already contaminated fuser rolls, the present embodiments relate to a marking system and fusing apparatus for inhibiting the formation or deposit of contaminants such as Zn fumarate on a fuser member. More specifically, the present invention relates to a system and apparatus using an internal cleaning web to deliver scavenging agents such as EDTA onto the surface of a heating roll and/or fuser roll. The present invention is not concerned with cleaning an already contaminated fuser roll but rather is directed to inhibiting the formation of contaminants on a fuser roll. Moreover, the present invention does not involve supplementary cleaning solution but utilizes fuser release fluid for delivery of scavenging agents.

BACKGROUND

The presently disclosed embodiments are directed to a system and apparatus that delivers agents that are useful in release coating in toner-based technologies. More particularly, the embodiments pertain to the delivery of metal chelating agents to release fluids to improve the fuser member life, especially in fusing systems that involve toners with zinc stearate additives.

In an image-forming or marking device, includes, but is not limited to, an electrostatographic, electrophotographic and/or xerographic device. In one embodiment, the marking apparatus or device employs a photoconductive component, for example a photosensitive belt or drum. The photoconductive member moves to advance successive portions sequentially through the various processing stations of the marking device disposed about the path of the photoconductive member.

Initially, a portion of the photoconductive surface passes through a charging station. At the charging station, the portion of the photoconductive member is charged, for example, by one or more corona-generating devices to a relatively high, substantially uniform potential.

Next, the charged portion of the photoconductive surface is advanced through an imaging station. At the imaging station, an original document is positioned on a scanning device such as a raster input scanner (RIS), a device known in the art. The RIS captures the entire image from original document and with an imaging module records an electrostatic latent image on the photoconductive surface of the photoconductive member. The imaging module may include, for example, a raster output scanner (ROS). The ROS lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

Thereafter, the photoconductive member advances the electrostatic latent image recorded thereon to a development station. At the development station, toner is applied to the electrostatic latent image to form a toner powder image on the photoconductive member surface. Any suitable development system may be used including magnetic brush developers, hybrid jumping developers, cloud developers, liquid developers and the like. The toner may be supplied from a developer comprised of the toner and carrier particles, or may be just a liquid or solid toner. Thus, at the development station, developer material is brought near the electrostatic latent image and the latent image attracts toner particles, in some instances, from the carrier granules of the developer material to form a toner powder image on the photoconductive surface.

The toned image on the photoconductive member surface is then advanced to a transfer station where an image-receiving substrate such as a paper sheet is moved into contact with the toner powder image. The toner image is transferred to the image-receiving substrate via any suitable process. Following transfer, the image-receiving substrate is advanced to the fusing station.

SUMMARY

In the present embodiments, the fusing station includes a fuser assembly that permanently affixes the transferred toner powder image to the image-receiving substrate. The fuser assembly or system includes heated fuser member such as heating rolls (X-rolls), a fuser roll and a pressure roller. The previously formed powder image on the image-receiving substrate is in contact with the fuser roll. The pressure roller is cammed against the fuser roll to provide the necessary pressure to fix the toner powder image to the substrate. The fuser roll may be internally heated, for example, by a quartz lamp and/or externally heated by heating rolls (X-rolls) as discussed above. Release agent such as silicone oil stored in a reservoir, may be pumped to a metering roll that feeds the release agent to the fuser roll. The image sheet is passed between the nip of the pressure roller and fuser roll where the heat and pressure act to melt and fix the toner image to the image-receiving substrate.

The fuser member or roll in one embodiment is heated by external heat rolls (X-rolls) that contact the surface of the fuser roll. To assist in maintaining these external heat rolls free of debris, a continuous cleaning web is kept in contact with the external heat rolls (X-Rolls). This cleaning web is fed around a web nip roll whereby the web is always positioned between the nip roll and the external heat rolls. The scavenging agents such as EDTA may be applied by the web to the X-rolls and then to the fuser roll or may be applied by the web directly to the fuser roll. Thus, in one embodiment, use is made of the existing X-roll cleaning web to deliver scavenging agents such as Zn scavenging agents onto the surfaces of the X-rolls and fuser roll or directly to the fuser roll to thereby inhibit the formation of contaminants on the fuser roll.

Zinc stearate is used in some current toner formulations for tribo stability and lubrication. However, it has been found that the Zn reacts with fumaric acid (contamination and toner decomposition product) and precipitates on the fuser roll and in the fuser oil, as Zn fumarate. The Zn fumarate contamination of the roll causes print defects and premature development of offset.

As noted, build-up of Zn fumarate on the surface of the fuser roll has been linked to print defects and, possibly, to premature offset. Utilization of Zn sequestering agents has long been proposed. These chemicals are typically ionic compounds that can chelate Zn ("wrap" themselves around Zn forming several coordination bonds to $Zn^{2+}$ ion). Unfortunately, these ionic agents are not soluble in cold silicone oil and have only limited solubility in hot oil. It is therefore difficult and challenging to deliver them onto the fuser roll surface. As above noted, in an embodiment of this invention, one can overcome this delivery problem by impregnating the X-roll cleaning web with a Zn sequestering agent. The chemicals are expected to be partially solubilized by the hot oil on the X-rolls as well as mechanically transferred to the fuser roll.

To test the present contamination inhibiting system and method, a cleaning web was prepared with five areas. Some areas of the web were impregnated with tetrasodium EDTA at a level of about 8-10 mg/in$^2$. Other areas were impregnated with sodium acetate (not chelating agent and possible control to decouple the cleaning effect of the non-reactive embedded particles) at the same level of 8 mg/in$^2$. The remaining parts or part of the web was also left untreated.

The same pattern (four stripes of different colors) was printed in each of the five areas using LX paper (stress test for the axial differential gloss lines). After 30K print, severe print defect (axial lines and irregular gloss patterns) were observed in all these areas not treated with EDTA. The printed patterns in the EDTA area did not show these defects. Further, evidencing the contamination inhibiting effect of the EDTA, the fuser roll appeared cleaner in the EDTA treated areas indicating lesser build-up of Zn fumarate. Further discussion on this test is presented herein relative to FIG. 2 below.

In one embodiment, EDTA solution may be used as the web impregnating agent. The EDTA may be used in any suitable solvent such as deionized water, isopropanol and mixtures thereof. The solution may contain EDTA from about 0.5%-30% and a suitable surfactant of abut 5%-15% by weight of the solution. It may have a pH of about 7-11.

It is much more desirable to use existing components in a marking system such as the cleaning web to distribute scavenging agents such as EDTA to the existing X-rolls and/or fuser roll surface to inhibit and minimize contamination of the fuser roll. This approach using existing components is much more convenient and time saving than removing the fuser roll for external cleaning or to add a cleaning station to the marking system. Also, the main concern of the present embodiments is not to provide systems to clean already contaminated fuser rolls but rather provide a means of preventing or inhibiting the future formation of contaminants on the fuser roll. The life of the fuser roll is substantially extended if the formation of debris and contamination is prevented or inhibited.

Preferred metal scavenging agents in this invention are ethylenediaminetetraacetic acid (EDTA) and its salts such as mono, di, tri and tetra sodium and potassium. All of them inclusive will be referred to in this disclosure and claims as "EDTA". Other suitable scavenging agents include succinic acid, diethylenetriaminepentacetic acid (DTPA), N-(hydroxyethyl) ethylene-diaminetetraacetic acid (HEDTA), nitrilotriacetic acid (NTA), 2,3-dimercaptosuccinic acid (DMSA), their salts and mixtures thereof.

DETAILED DISCUSSION OF DRAWINGS AND PREFERRED EMBODIMENTS

Figure 1:
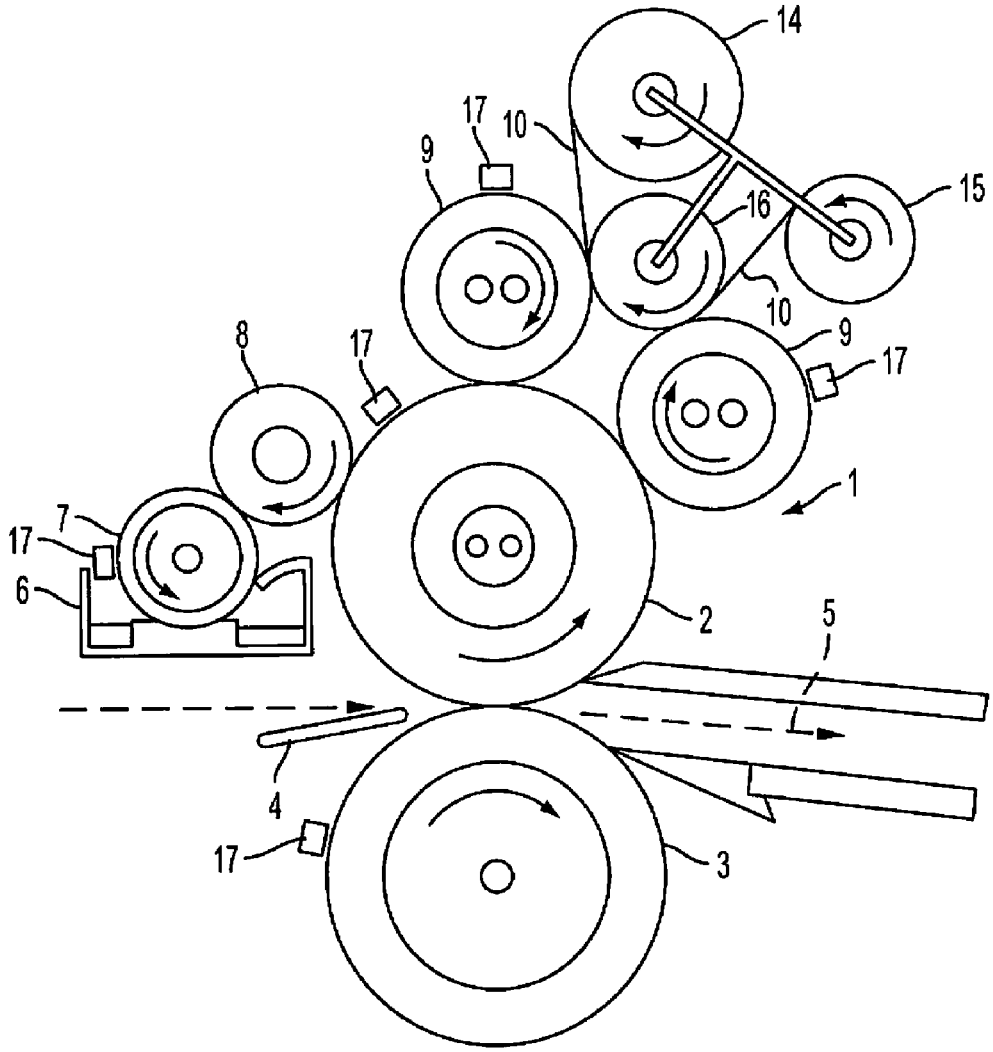
FIG. 1 illustrates a fuser system in an electrostatic marking apparatus using the impregnated fuser cleaning web of this invention.

In FIG. 1, a fuser system 1 is illustrated having a fuser roll 2, a pressure roll 3 and a paper transport 4 which directs a paper-receiving medium 5 through a nip between rolls 2 and 3. The arrows on fuser roll 2 and pressure roll 3 indicate the rotational direction of each roll. A release agent reservoir 6 is shown in operative relationship to a meter roll 7 and a donor roll 8. In operative contact with the fuser roll 2 are two external heat rolls 9 (X-rolls), the X-rolls 9 are both in contact with a cleaning web 10 which is impregnated with the scavenging agent, EDTA (in the form of tetrasodium salt). Generally, a suitable impregnation is 8 milligrams of EDTA/square inch of web. This suitable measured amount of EDTA transfers from web 10 to existing X-rolls 9 and from X-rolls 9 to the surface of fuser roll 2. This inhibits formation of debris such as Zn fumarate and other contaminates from forming on the surface of fuser roll 2. The Zn fumarate (originating from Zn stearate in toner) contaminate causes print defects and premature development of offset. By using existing components of the fuser system 1 such as the web 10 and the X-rolls 9, an additional cleaning station as used in some prior art need not be installed in system 1. Since space is always a serious consideration in marking or electrophotographic systems, avoiding the necessity of a cleaning station is important. Also, using the cleaning web 10 and X-rolls 9 to inhibit contamination of the fuser roll 2 avoids the necessity of removing the fuser roll for external cleaning. This down time of the system 1 is important time-wise and monetarily. As earlier noted, the EDTA is impregnated into web 10 at a level of about 2 to 10 mg/in$^2$. Any suitable solution comprising EDTA may be used such as a solution containing EDTA from about 0.5%-30% by weight of the solution. In an embodiment, a suitable surfactant such as 1-methoxy-2 propanol may be added to the solution in order to improve wetting of the polyarylamide web material. Obviously, conditions will determine what amount of surfactant and of EDTA is needed to accomplish this inhibiting effect. The solution can have a pH of about from 7-11. In lieu of the cleaning web 10 contacting the X-rolls, it may be desirable in some embodiments to have the impregnated web 10 directly contact the fuser roll 2 to inhibit or minimize formation of Zn fumarate and other contaminates from the surface of fuser roll 2. In FIG. 1, boxes 17 located adjacent rollers 2, 3 and 9 are thermostats.

The impregnated web 10 is supplied from web supply roll 15 and the web moves to web take-up roll 14 for re-use or for replacement.

Figure 2:
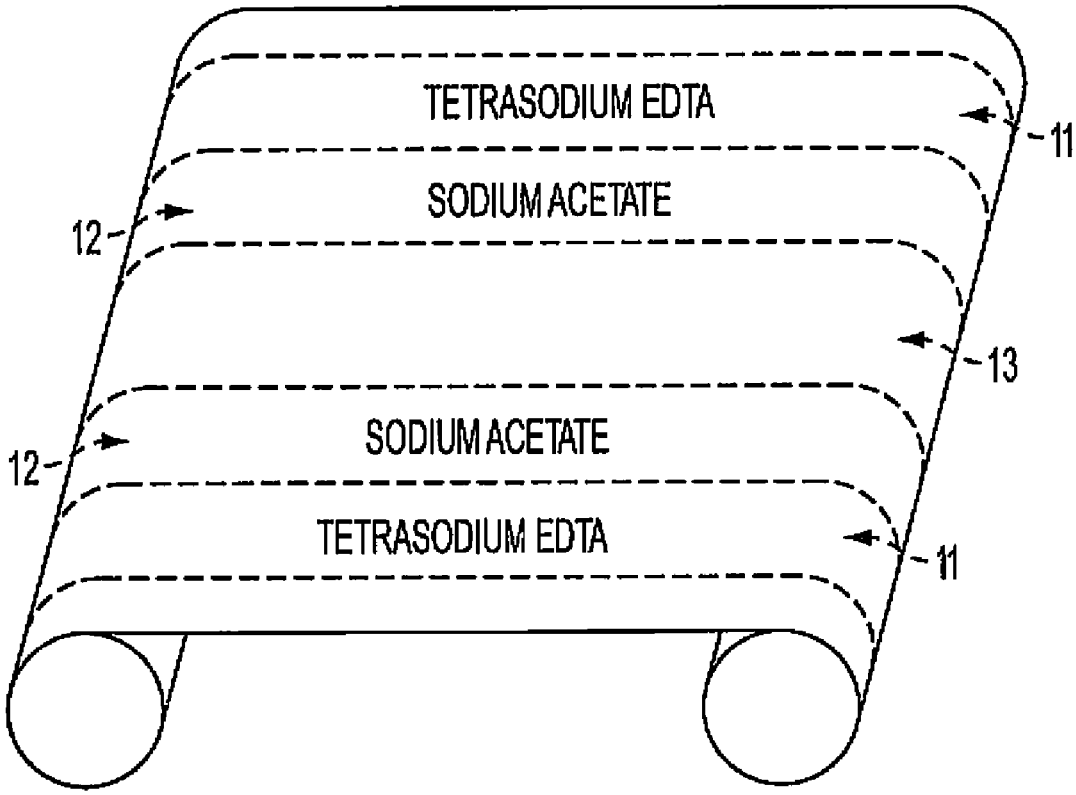
FIG. 2 illustrates a test cleaning web to test the effectiveness of embodiments of the present invention.

In FIG. 2, it is known, as above noted, that build-up of Zn fumarate on the surface of the fuser roll has been linked to shortened fuser roll life, print defects and, possibly, to premature offset. Thus, prevention or inhibiting this Zn fumarate build-up is more desirable than cleaning an already contaminated fuser roll and possibly damaging the fuser roll. As earlier mentioned, utilization of Zn sequestering agents as cleaners in and out of the system has long been proposed. These chemicals are typically ionic compounds that can chelate Zn ("wrap" themselves around Zn forming several coordination bonds to $Zn^{2+}$ ion). Unfortunately, these ionic agents are not soluble in cold silicone oil and have only limited solubility in hot oil. It is therefore challenging to deliver them onto the fuser roll surface. This delivery problem can be overcome in the present invention by impregnating the X-roll cleaning web with a Zn sequestering agent such as EDTA. The chemicals are expected to be partially solubilized by the hot oil on the X-rolls as well as mechanically transferred to the fuser roll.

To test an embodiment of the method, a cleaning web was prepared with five areas as shown in FIG. 2. The areas of the web were impregnated at 11 with tetrasodium EDTA at a level of 8 mg/in$^2$, some areas with sodium acetate at locations 12 at the same level of 8 mg/in$^2$. Part of the web was also left untreated as shown at sections or locations 13.

The same stress pattern (four stripes of different colors) was printed I each of the five areas using LX paper (stress test for the axial gelation lines). After 30K print severe print defect (axial differential gloss lines and irregular gloss patterns) were observed in all three areas not treated with EDTA. The printed patterns in the EDTA area did not show these defects. Additionally, the fuser roll appeared cleaner in the EDTA treated areas indicating lesser build-up of Zn fumarate. This showed clearly that the EDTA inhibited formation of the Zn fumarate in the EDTA treated areas. Similar results are expected using the other metal chelating agents disclosed and claimed herein since many of their properties are very similar to EDTA.

Figure 3:
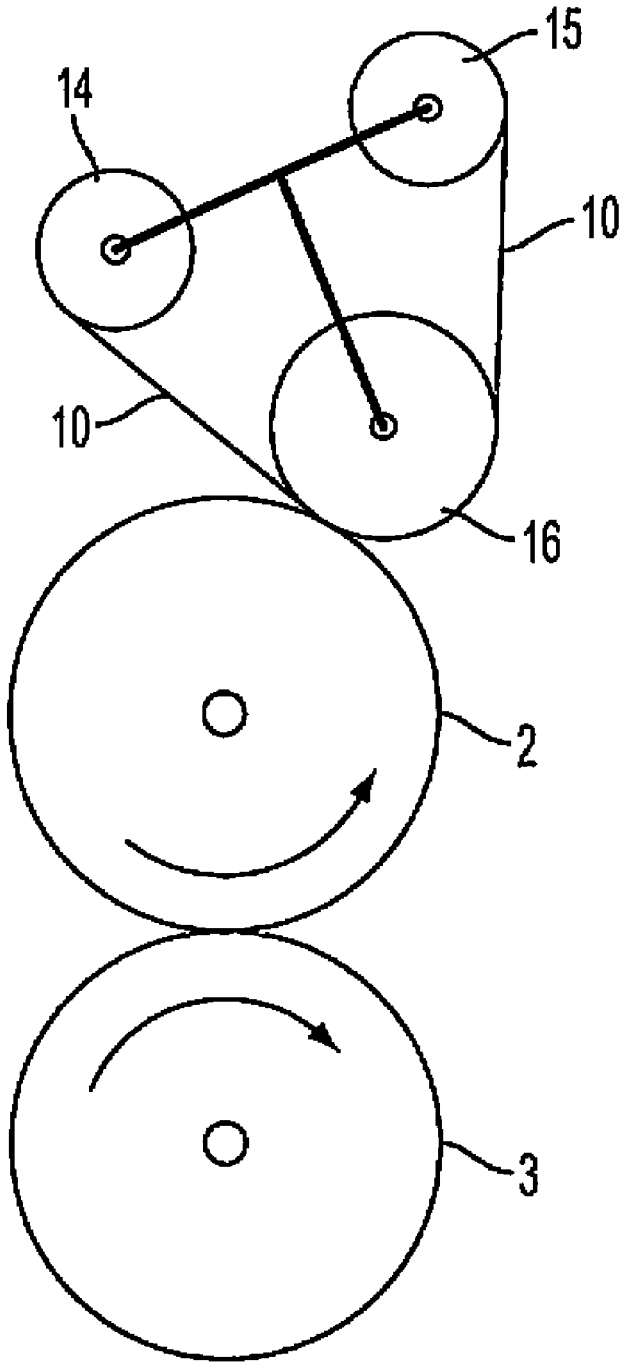
FIG. 3 illustrates a cleaning system where the web directly contacts the fuser roll.

In FIG. 3, impregnated web 10 directly contacts fuser roll 2 (as opposed to contacting X-rolls 9) to inhibit formation on its surface of Zn fumarate debris and other contaminates. Otherwise all of the above discussion relating to FIG. 1 equally applies to FIG. 3. In one embodiment the fusing system comprises in an operative arrangement an impregnated cleaning web and a fuser member. The cleaning web is impregnated with a debris inhibiting amount of a metal chelating agent selected from the group consisting of ethylenediaminetetraacetic acid (EDTA), succinic acid, diethylenetriaminepentacetic acid (DPTA), N-(hydroxyethyl) ethylene-diaminetetraacetic acid (HEDTA), nitrilotriacetic acid (NTA),2,3-dimercaptosuccinic acid (DMSA), their salts and mixtures thereof.

In another embodiment the fusing system herein is useful in inhibiting Zn containing contamination in an electrophotographic marking system. The system comprises in an operative arrangement, an impregnated movable cleaning web and a fuser roll. The web is impregnated with a composition of a surfactant and EDTA and adapted to directly or indirectly transfer at least a portion of said EDTA containing composition to said fuser roll surface. Thereby in this debris inhibiting step, it assists to prevent formation on said surface of at least some Zn fumarate. The web is enabled to continuously supply said EDTA directly or indirectly to said fuser roll and enabled to continuously inhibit formation of said Zn fumarate from said fuser roll. This system provides that said impregnated web is in contact with two X-rolls and enabled thereby to transfer at least a cleaning amount of EDTA to said X-rolls.

This system also provides in another embodiment where said web contacts at least one external heat roll (X-roll) and wherein said heat roll(s) are enabled to operatively contact said fuser roll.

The web is also available to contact said fuser roll directly.

To summarize, various embodiments of this invention provide a fusing system having in an operative arrangement a cleaning web and a fuser member. The web is impregnated with a debris inhibiting amount of a member selected from the group consisting of EDTA or other suitable chelating agent. The web can directly contact the surface of the fuser roll or it can contact the x-rolls which in turn will transfer the chelating agent to the fuser roll. The EDTA can be in solution prior to the impregnation into the web. In one embodiment it has a pH of bout 7-11 and is present in the solution in an amount of from 0.5% to about 30% by weight of the solution. Obviously, any suitable amount of EDTA may be used.

A surfactant is used in one embodiment with the EDTA; the surfactant can be added in an amount of from 5%-15% by weight of the solution.

The preferred and optimally preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A fuser cleaning apparatus, the apparatus comprising:

a rotatable fuser member;

a cleaning web, the cleaning web being impregnated with a chelating agent, the cleaning web being translatable, and the cleaning web being arranged to directly contact the rotatable fuser member whereby the chelating agent is transferred to the rotatable fuser member to inhibit Zn contamination on the rotatable fuser member.

2. The fuser cleaning apparatus according to claim 1, the cleaning web being impregnated with a surfactant, wherein the surfactant improves wetting of the cleaning web.

3. The fuser cleaning apparatus according to claim 1, wherein the cleaning web is heated.

4. The fuser cleaning apparatus according to claim 1, the fuser member being heated.

5. The fuser cleaning apparatus according to claim 1, the chelating agent being an EDTA solution, the EDTA solution comprising a solvent being selected from the group consisting of deionized water, isopropanol, and mixtures thereof.

6. The fuser cleaning apparatus according to claim 1, the chelating agent being selected from the group consisting of EDTA, succinic acid, DTPA, HEDTA, NTA, DMSA, their salts and mixtures thereof.

* * * * *